US008186127B1

(12) United States Patent
Pratt

(10) Patent No.: US 8,186,127 B1
(45) Date of Patent: May 29, 2012

(54) BASEMENT WATER DRAINAGE METHOD FOR USE WITH A FOUNDATION HAVING NO FOOTING

(76) Inventor: James M. Pratt, Needham, MA (US)

( * ) Notice: Subject to any disclaimer, the term of this patent is extended or adjusted under 35 U.S.C. 154(b) by 0 days.

(21) Appl. No.: 12/925,838

(22) Filed: Nov. 1, 2010

(51) Int. Cl.
*E02D 19/00* (2006.01)
*E04G 23/00* (2006.01)

(52) U.S. Cl. ..... 52/741.11; 52/169.5; 52/302.3; 52/302.1; 52/62

(58) Field of Classification Search ..... 52/741.11, 52/169.5, 302.3, 302.1, 61, 62, 58, 97, 219, 52/302.6, 716.2
See application file for complete search history.

(56) References Cited

U.S. PATENT DOCUMENTS 4,333,281 A * 6/1982 Scarfone ..... 52/169.5
4,612,742 A * 9/1986 Bevilacqua ..... 52/169.5
5,501,044 A * 3/1996 Janesky ..... 52/169.5
6,230,468 B1 * 5/2001 Klaus ..... 52/741.11
6,598,360 B1 * 7/2003 Pratt ..... 52/169.5
6,634,144 B1 * 10/2003 Moore et al. ..... 52/169.5
7,380,374 B1 * 6/2008 Pratt ..... 52/169.5
7,832,150 B1 * 11/2010 Pratt ..... 52/61
7,836,640 B1 * 11/2010 Pratt ..... 52/61
7,918,055 B2 * 4/2011 Cotten ..... 52/169.5
2007/0294965 A1 * 12/2007 Andras ..... 52/169.5
2008/0190045 A1 * 8/2008 Janesky ..... 52/169.5
2011/0041426 A1 * 2/2011 Trotter ..... 52/169.5

* cited by examiner

*Primary Examiner* — Brian Glessner
*Assistant Examiner* — Babajide Demuren
(74) *Attorney, Agent, or Firm* — William Nitkin

(57) ABSTRACT

A method of draining water entering a building having a foundation wall with no footing by removing a portion of the slab floor adjacent to the foundation wall and digging a trench and a divot trench, placing a cove base against felt and against the foundation wall with the cove base extending from above the slab floor and down into the trench divot. The trench divot is lined with felt, and a drain conduit is placed into the trench having apertures aligned with apertures formed in the cove base to direct water coming from the foundation wall behind the cove base, through the aligned apertures to be directed into the conduit to a remote location, such conduit being covered by fill and a vapor barrier and with concrete poured thereover and leveled to the height of the slab floor.

4 Claims, 1 Drawing Sheet

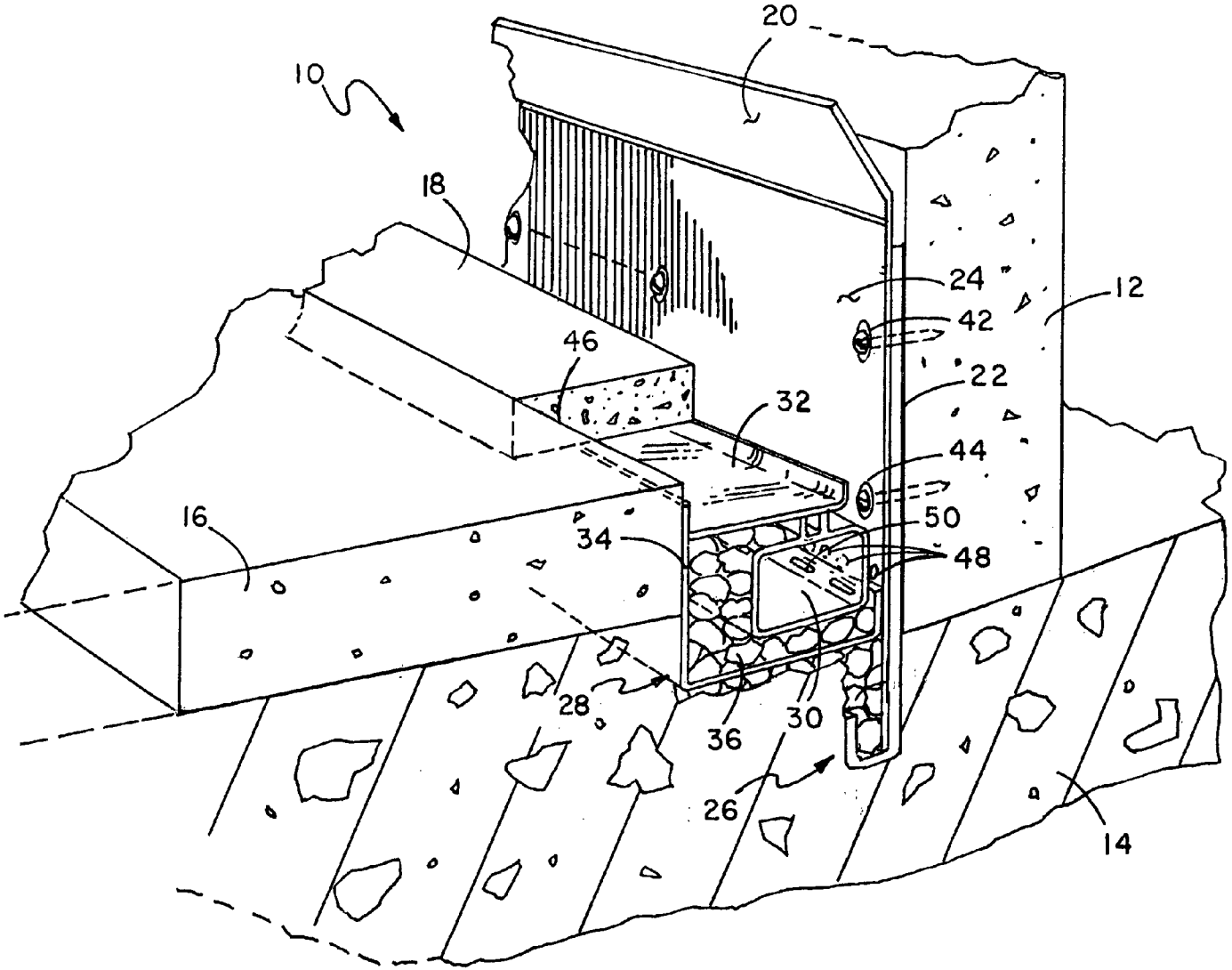
10
12
14
16
18
20
22
24
26
28
30
32
34
36
42
44
46
48
50

BASEMENT WATER DRAINAGE METHOD FOR USE WITH A FOUNDATION HAVING NO FOOTING

BACKGROUND OF THE INVENTION

1. Field of the Invention

The invention resides in the field of basement water drainage systems using conduits around the inside of the foundation of a building to direct water to a selected location such as a collection point and more particularly relates to a system and method of directing water in a basement whose foundation lacks a footing by using a method to direct the water below the flooring adjacent to the foundation and into a conduit to a collection point.

2. History of the Prior Art

Structures to prevent or redirect water seepage from passing into a basement through or under a foundation wall have been utilized in the past. Many of such structures utilize a barrier disposed against the foundation to direct the water down to a drainage system in the floor. Conduits have also been used that provide for water collection and for the creation of a diversion space formed at the base of the foundation wall. In such cases the collection system installed can, in fact, collect the soil or sand and add to the erosion. Some of such conduits are substantially rectangular in cross-section. In particular my prior U.S. Pat. No. 6,598,603 teaches that conduits can be used in situations where the foundation wall has no footing by incorporating various degrees of pitch to the conduit that is positioned under the concrete floor adjacent to the foundation wall to direct fluid entering through apertures formed in the conduit to a collection point, such as a sump pump pit or a discharge point. In U.S. Pat. No. 6,598,603 it is taught that the conduit can be placed in gravel with the concrete slab floor poured thereover.

SUMMARY OF THE INVENTION

It is an object of this invention to provide an improved system and method for basement drainage in situations where there is no footing formed under the foundation wall. The construction of this invention around the inner perimeter of the foundation wall provides for improved water collection as water that seeps through or under the foundation wall is collected in an area formed using the system and method of this invention and directed into a substantially rectangular conduit extending around the perimeter of the basement, as described further below.

In some building foundations lacking a footing, seepage and underwash can cause water to pass through sand or loose soil under the foundation wall which seepage not only allows water into the basement area, but also can cause damage to the building from soil erosion under the foundation. In situations where it is desired to have an improved water collection system around the inner perimeter of such a basement, the installer using the method of this invention first removes approximately 5 inches of the concrete slab floor adjacent to the foundation wall. The installer then digs a trench approximately 5 inches deep and 5 inches wide having a trench divot immediately adjacent to the inside face of the foundation that is 2-3 inches deep and approximately 1 inch wide, referred to as a trench divot. A cove base is then installed on the foundation wall around its inner perimeter which cove base extends from the bottom of the trench divot to a height above the top of the slab floor where the cove base has an inwardly extending cove base extension that aids in collecting water flowing down the inside face of the foundation wall. Positioned behind the cove base is a cove base backing felt that extends from a point above the top of the slab floor down to the bottom of the divot and then extends further around the bottom of the trench divot and then extends upward on the inside wall of the trench divot. The cove base is attached to the interior foundation wall by a plurality of fasteners which pass through the cove base and the backing felt and hold both sandwiched together against the inside of the foundation wall. The trench divot is then filled with stone up to the bottom of the 5 inch wide trench. The 5 inch wide trench is then lined along the inside of the slab floor extending downward with a trench felt which trench felt extends along the inner face of the cut slab floor down the inner side of the 5 inch wide trench and then extends around the 5 inch wide trench's bottom to the cove base where it extends upward a short distance. A small amount of stones is added to the trench, and a drain pipe is positioned in the trench adjacent to the cove base. The drain pipe can be of the type described in my U.S. Pat. No. 6,598,360 which is expressly incorporated herein. A plurality of apertures are defined in the cove base and are disposed above the top of the trench felt positioned against the cove base and which trench felt extends upward on the cove base such that the apertures in the drain pipe or conduit substantially align with the apertures defined in the cove base. Thus, water passing down the inside of the foundation wall and through the backing felt will pass through the cove base apertures, through the apertures in the drain pipe and into the drain pipe to flow to a selected location such as a remote collection or disposal point. The apertures that are drilled in the cove base at the level of the waterproofing system allow the backing felt to permit water into the conduit while stopping sand from entering and being carried away and thus undermining the foundation. The felt extending along the inside face of the cove base can be glued to the cove base. One then can install more stones or gravel around the drain pipe and cover the drain pipe and stones/gravel with an approximately 5½ inch wide clear vapor barrier which can be held in place by tape taping the vapor barrier to the cove base. One then can pour concrete to fill the area above the trench on top of the vapor barrier and level the floor to the level of the original slab floor to the cove base. The structure now installed extends below the bottom of the foundation and prevents any substantial water flow from passing under the foundation wall while at the same time directing water flow coming from behind the cove base through the cove base backing felt, through the apertures formed in the cove base adjacent to the apertures in the drain pipe such that water flowing down the inside face of the foundation wall will pass into the drain pipe and then be drained away to a desired location. The system of this invention in some cases can be utilized with foundations that have footings that are structured so as to allow for the installation of the system of this invention.

BRIEF DESCRIPTION OF THE DRAWING

The FIGURE illustrates a perspective cross-sectional cutaway view of the system and method of this invention installed in a basement around the inner perimeter of the foundation wall.

DESCRIPTION OF THE PREFERRED EMBODIMENT(S)

The FIGURE illustrates a perspective cross-sectional cutaway view of the system and method of this invention installed in basement 10, it being understood that the cross section provided would extend around the inner perimeter of the basement with drain pipe 30 incorporated therein. Drain pipe 30 extends and directs water flow to a collection point, such as a sump pump pit, drain or some other means of dispersal of the water. Drain pipe 30 can be a WATER TREK® brand pipe, such as described in U.S. Pat. No. 6,598,603 and sold by Basement Technologies, Inc. of P.O. Box 920624, Needham, Mass. 02492.

In practicing the method of this invention, one first removes a section of concrete slab floor 16 approximately 5 inches from around the inner perimeter of foundation wall 12 which rests on, or is buried in, ground 14. Foundation wall 12 in basement 10 is of the type that lacks a footing which type of structure is susceptible to various water leakage and erosion problems. A trench 28 being approximately 5 inches deep and 5 inches wide is dug between the end of slab floor 16 and the interior of foundation wall 12 forming trench side wall 46. A trench divot 26 is dug at the bottom of trench 28 adjacent to the interior of foundation wall 12 further downward approximately 2-3 inches deep and approximately 1 inch wide. A cove base 24 that is a substantially flat piece of plastic having an upper inwardly extending cove base extension 20 is positioned adjacent to the interior of foundation wall 12, and its bottom is positioned at the bottom of trench divot 26. A substantially planar cove base backing felt 22 is positioned between cove base 24 and foundation wall 12. Cove base backing felt 22 extends under the bottom of the cove base along the bottom of trench divot 26 and extends upward on the inner side of trench divot 26. A plurality of fasteners which can be of the Christmas tree type having ribbed shafts and circular fins, such as first fastener 42 and second fastener 44, and can be passed through the plurality of apertures formed in cove base 24 and cove base backing felt 22 to retain cove base 24 and cove base backing felt 22 securely to foundation wall 12. One can then fill trench divot 26 with gravel or stones up to the bottom of trench 28. Also defined in cove base 24 are a plurality of cove base apertures 48 which extend in a horizontal row parallel to the length of cove base 24. A trench felt 34 is positioned along trench side wall 46 of slab floor 16 extending downward to the bottom of trench 28 where it extends toward cove base 24 and then upwards along cove base 24 a short distance ending below cove base apertures 48. This small portion of trench felt 34 extending up along cove base 24 can be attached to cove base 24 by an adhesive such as BOSTIK® brand adhesive or other equivalent adhesive product. Apertures 48 in cove base 24 can be ½ inch in diameter and can be drilled into cove base 24 when their desired height is determined by the installer. Care should be taken not to drill through cove base backing felt 22. Drain pipe 30 should be positioned in trench 28 resting on stone or gravel 36 adjacent to apertures 48 in cove base 24 so that the apertures 50 in the side of drain pipe 30 align with apertures 48 and then the balance of trench 28 can be filled with stone or gravel to approximately 1-2 inches from the top of slab floor 16. Vapor barrier 32 which can be of clear plastic is placed on top of the stone or gravel and drain pipe 30 in trench 28, and vapor barrier 32 extends from trench felt 34 adjacent to slab floor 16 to the inside face of cove base 24 where the vapor barrier can extend upwards a short distance. The upwardly extending portion of vapor barrier 32 can be held by adhesive tape to cove base 24. The taping of the upwardly extending portion of vapor barrier 32 to cove base 24 helps ensure that vapor barrier 32 does not allow any poured concrete to pass between drain pipe 30 and cove base 24. Concrete fill 18 is then added to the area defined between trench side wall 46 of slab floor 16 and the inner side of cove base 24 and is then smoothed over.

Although the present invention has been described with reference to particular embodiments, it will be apparent to those skilled in the art that variations and modifications can be substituted therefor without departing from the principles and spirit of the invention.

I claim:

1. A method for draining water for use with a building having a foundation wall, said foundation wall having an interior, an inner perimeter, and a base but no footing, said foundation wall surrounding a basement having a slab floor extending to inner perimeter of said foundation wall, said slab floor having a level and a top, comprising the steps of:

removing a portion of said slab floor adjacent to said foundation wall, said portion being approximately 5 inches wide, creating an inside face of said slab floor:

digging a trench adjacent to said foundation wall where said slab floor has been removed, said trench being approximately 5 inches deep and 5 inches wide, said trench having a bottom, digging a trench divot having a bottom, and first and second sides disposed substantially parallel to one another, said first side disposed adjacent to said foundation wall and a second side disposed away from said foundation wall, said trench divot being approximately 1 inch wide and 2-3 inches deep at said bottom of said trench divot adjacent to the inside of said foundation wall;

providing a substantially planar cove base having a top, said cove base positioned around said inner perimeter of said foundation wall, said cove base extending into said trench divot and upwards to a height above said top of said slab floor;

providing a cove base extension extending inward from said top of said cove base away from said inner perimeter of said foundation wall;

positioning a backing felt between said cove base and said inner perimeter of said foundation wall, said backing felt extending down said first side of said trench divot to said trench divot bottom and further around said trench divot bottom and up said second side of said trench divot;

attaching said cove base through said backing felt to said foundation wall;

filling said trench divot with gravel or stone;

lining said trench with felt, said felt contacting and extending from a lining contact height on said cove base within said trench, along said bottom of said trench and up said inside face of said slab floor;

partially filling said trench with gravel or stone;

providing a plurality of apertures disposed in a horizontal row in said cove base, said plurality of apertures positioned above said lining contact height, said trench felt contacting said cove base in said trench;

providing a drain pipe having a plurality of apertures defined therein, said drain pipe positioned in said partially filled trench;

aligning said plurality of apertures in said drain pipe with said plurality of apertures defined in said cove base;

covering said drain pipe in said trench with gravel or stone;

providing a vapor barrier;

positioning said vapor barrier over said filled trench, said vapor barrier extending from said cove base to said felt in said trench adjacent to said inside face of said slab floor;

filling the area defined between said slab floor and said cove base and above said vapor barrier with concrete;

leveling said concrete to said level of said slab floor; and allowing water flowing down said interior of said foundation wall to be directed by said cover base and said cove base extension to the area defined behind said cove base occupied by said backing felt, said backing felt allowing water to pass therethrough and through said plurality of apertures defined in said cove base and through said aligned apertures defined in said drain pipe, said drain pipe directing said water to a selected location.

2. The method of claim 1 further including the step of:

positioning said bottom of said cove base within said trench divot extending below said base of said foundation wall for preventing said water flow from passing immediately under said foundation wall.

3. The method of claim 2 further including the step of:

providing a drain pipe having a substantially rectangular cross-section and first and second upright sides disposed substantially parallel to one another, said first upright side disposed adjacent to said cove base; and positioning said drain pipe against said cove base with said plurality of apertures in said drain pipe defined in said first and second upright sides of said drain pipe for positioning said apertures in said first upright side in alignment with said plurality of apertures defined in said cove base.

4. The method of claim 3 further including the step of:

attaching said vapor barrier to said cove base.

* * * * *